US005921123A

United States Patent [19]

Schwarzkopf et al.

[11] Patent Number: 5,921,123

[45] Date of Patent: Jul. 13, 1999

[54] REKEYABLE PADLOCK

[75] Inventors: Norbert Schwarzkopf, Hagen; Raymond Gunther, Wuppertal; Gerhard Meckbach, Hagen, all of Germany

[73] Assignee: ABUS August Bremicker Soehne AG, Wetter, Germany

[21] Appl. No.: 08/844,513

[22] Filed: Apr. 18, 1997

[51] Int. Cl.[6] ..... E05B 9/04

[52] U.S. Cl. ..... 70/371; 70/40

[58] Field of Search ..... 70/40, 48, 369–371, 70/38, 38 A–38 R

[56] References Cited

U.S. PATENT DOCUMENTS

| | | | |
|---|---|---|---|
| 1,147,595 | 7/1915 | Barb | 70/38 A |
| 1,637,953 | 8/1927 | Maxwell | 70/367 |
| 1,660,903 | 2/1928 | Adamson | 70/38 A |
| 2,199,336 | 4/1940 | Fletcher | 70/371 |
| 3,835,675 | 9/1974 | Lippisch | 70/38 A |
| 3,952,565 | 4/1976 | Falk | 70/417 |
| 4,112,715 | 9/1978 | Uyeda | 70/38 A |
| 4,290,280 | 9/1981 | Yun | 70/38 A |
| 4,545,223 | 10/1985 | Poutiainen | 70/38 A |
| 4,658,606 | 4/1987 | Tseng | 70/38 A |
| 4,918,950 | 4/1990 | Foshee | 70/38 A |
| 4,998,423 | 3/1991 | Hsu | 70/40 |
| 5,044,180 | 9/1991 | Lebrecht | 70/48 |

FOREIGN PATENT DOCUMENTS

| | | |
|---|---|---|
| 66985 | 6/1948 | Denmark . |
| 4310589A1 | 10/1993 | Germany . |

OTHER PUBLICATIONS

Excerpts from ABUS product catalog and brochures.

*Primary Examiner*—Suzanne Dino Barrett

*Attorney, Agent, or Firm*—Townsend and Townsend and Crew LLP

[57] ABSTRACT

A rekeyable padlock comprises a lock housing, a generally U-shaped recess formed in said lock housing and having an entry side, a guide channel defined within said housing, a shackle movable within said channel between an open position in which it is retracted into said housing and frees said entry side of said recess, and a closed position in which it is partly located outside of said housing and closes off said entry side, a lock cylinder, means removably mounting said lock cylinder in said lock housing, a cam movable by said lock cylinder and having an abutment member engageable with said shackle to move said shackle from said open position to said closed position and vice verse, a latch member biased into position in front of a shoulder of said mounting means prohibiting withdrawal of said lock cylinder and means accessible through said recess when said shackle is in said open position, but not when said shackle is in said closed position, for releasing said latch member from said shoulder to permit withdrawal of said lock cylinder from said lock housing and replacement of said lock cylinder by a substitute lock cylinder

25 Claims, 4 Drawing Sheets

REKEYABLE PADLOCK

FIELD OF THE INVENTION

The present invention relates to a rekeyable padlock of the type comprising a lock housing, a generally U-shaped recess formed in said lock housing and having an entry side, a guide channel defined within said housing, a shackle movable within said channel between an open position in which it is retracted into said housing and frees said entry side of said recess, and a closed position in which it is partly located outside of said housing and closes off said entry side, a lock cylinder, means removably mounting said lock cylinder in said lock housing, a cam movable by said lock cylinder and having an abutment member engageable with said shackle to move said shackle from an open position to said closed position and vice versa.

DESCRIPTION OF PRIOR ART

A padlock of this kind is known from U.S. Pat. No. 4,998,423 and is basically a minor modification of the so-called "Diskus" type padlocks or padlocks which were first introduced by the company August Bremicke Sohne KG of 58300 Wetter, Germany, many years ago and which have been sold since the early 1950's under the name "DISKUS" (Registered Trade Mark).

Such locks have in the past been sold with lock cylinders which were not readily exchangeable, so that the locks were not rekeyable. The term rekeyable will be understood to mean that if a key is lost, or if it is suspected that a key has been acquired by an unauthorized person, it is possible to change the lock cylinder for a new one, operable with a different key without having to rekey the whole lock.

In the modification provided by U.S. Pat. No. 4,998,423 the lock cylinder or lock gore is secured by a screw insertable through a threaded bore in a plate member disposed within the lock housing inside of the open ring-shaped shackle. The screw is accessible to permit a removal of the lock cylinder only when the shackle in an intermediate position between the closed and the open position. In this intermediate position a cut-out in the shackle is disposed largely opposite to said recess and access to the locking screw securing the lock cylinder in the lock is achieved through the recess in the shackle. Since the recess is not very deep or long and the abutment member of the cam is also present in this recess, access to the locking screw is not very convenient and thus exchange of the lock cylinder is awkward.

In addition, the relatively small screw can be lost within the lock mechanism, which causes a substantial further complication because the lock itself is generally of a sealed construction and cannot easily be opened.

Furthermore, the initial assembly of the lock is rather complicated, which increases the cost of manufacture.

SUMMARY OF THE INVENTION

The principal object underlying the present invention is to provide an alternative way of making known padlocks rekeyable and indeed to ensure that it is relatively forward forward to exchange the lock cylinder when necessary, to ensure that the lock is easy to assemble during manufacture and thus cost-favorable to produce, to ensure that the lock is secure against tampering by an authorized person, and to effect the redesign in a manner which requires only a stall modification to known locks of the "Diskus" type.

Although the invention is particularly directed to improving discus; type padlocks, it is also more generally applicable to padlocks, as will be later explained in more detail.

In order to satisfy the above object, there is provided a padlock of the initially named kind, which further includes a latch member biased into position in front of a shoulder of said mounting means prohibiting withdrawal of said lock cylinder, and means accessible through said recess when said shackle is in said open position, but not when said shackle is in said closed position, for releasing said latch member from said shoulder to permit the withdrawal of said lock cylinder from said lock housing and replacement of said lock cylinder by a substitute lock cylinder.

Thus, it is basically only necessary to provide an additional latch member in the existing lock and to provide the means for mounting the lock cylinder within the lock with a suitable shoulder capable of cooperating with the latch member in order to make the existing lock rekeyable.

Because the latch member is accessible through the opening in the side of the recess, into which the shackle normally engages in the closed position of the lock, it is completely inaccessible when the lock is closed, so that the lock is secure against tampering. On the other hand, when the lock is opened, it is easy to disengage the latch member from the shoulder, which permits withdrawal of the lock cylinder from the lock housing.

In a preferred embodiment, in which a catch member is provided which is biased in the closed position of the shackle against an abutment provided thereon to prevent an opening movement of the shackle, the mounting means is provided with a second shoulder at a side generally opposite from the first said shoulder, and the catch member is provided with a second latch member engageable in the closed position of the shackle in front of the second shoulder. This means that the mounting means for the lock cylinder is restrained at two opposite sides against movement out of the lock housing. This is a particularly stable arrangement and one in which, in the closed position of the shackle, it is virtually impossible to remove the lock cylinder without destroying the lock.

It should be noted that the lock cylinder may be integral with the mounting means, which is then simply formed by correspondingly shaped features such as the first and second shoulder provided on the lock cylinder, or the lock cylinder may be separate from the mounting means. When the lock cylinder is separate from the mounting means, then the mounting means conveniently has a recess complementary to an outer profile of the lock cylinder for receiving at least a portion of the lock cylinder and an abutment engageable with a first end of the lock cylinder to prevent movement of the lock cylinder through the mounting means. A driving dog provided at the other end of the lock cylinder is engageable within a recess or aperture of complementary shape in the cam in order to transmit torque to the cam on rotation of the key. The cam, or means associated therewith, then prevents movement of the lock cylinder away from the mounting means. Thus, the lock cylinder is restrained from movement away from the mounting means in both directions and is thus securely mounted in the lock.

In a particularly preferred embodiment of the padlock, the latch member and the catch member are disposed between first and second internal plates of the housing, and spacer means is provided between the first and second plates, maintaining them at a predetermined spacing from one another. The mounting means then conveniently has a spigot member of non-circular cross-rection which merges via a step into a portion of greater diameter. The non-circular spigot portion engages into a complementary aperture in at least one of the front plate and a front wall of the lock housing and prevents rotation of the mounting means relative to the plate and to the lock housing. The first said shoulder, and the second shoulder if provided, are defined on the opposite side of the first plate from the step and the first said latch member and, it provided, the second latch member engage(s) between the respective shoulders and the first plate.

This arrangement has the advantage that the latch member or members only need to prevent movement of the mounting means for the lock cylinder out of the lock housing, and the step on the mounting means prevents movement of the mounting means in the opposite direction The torque required to restrain the mounting means from moving when the key is turned in the lock cylinder is achieved by engagement of the non-circular spigot in the correspondingly shaped aperture in the first said plate and/or in the front wall of the housing.

The portion of the mounting means of greater diameter, which may, for example, be circular—if a circular aperture is provided in the front wall of the look housing—or flattened at one or more sides, preferably has a radius blending from the point of which it merges from the wall of the lock housing into its exposed end face. This makes it very difficult for a person intent on tampering with the lock to obtain a grip on the mounting means with a tool in an attempt to force it out of the lock housing.

Although it is preferred to have the spigot member of non-circular cross-section engage in both the first plate and in a complementary shaped aperture in the front wall of the lock housing it is also possible to dispense with the said first plate altogether, in which case the spacer members would be permanently fixed to the front wall of the lock housing, for example by welding.

A particularly important advantage of the present invention is that the latch member can be pivotally supported on a spacer member provided between the first and second plates without the need to provide any additional locating or mounting means within the lock housing, A spring similar to a clothes peg spring can be disposed with its coils around the spacer, with one leg mounted against the lock housing and the other leg against the latch member to bias the latch member towards the position in which it is engaged in front of the first shoulder. Thus, only a spring member and a latch member need additionally be provided in order to realize the present invention. It is, of course, also necessary to provide the shoulder on the mounting means. However, this can be done, for example, simply by machining a groove into the spigot of the existing mounting means.

The second latch member provided on the catch simply represents an extension of one limb of the U-shaped catch member, traditionally used in Diskus type locks. Again, this extended limb, i.e. the second latch member, simply engages into a shoulder which can again be conveniently formed by a second groove machined into the previously known spigot portion of the mounting means for the lock cylinder.

It is also possible, in accordance with a particularly preferred embodiment of the invention, to arrange the first latch member so that it contacts the shackle, or almost contacts the shackle, in the closed position of the lock, i.e. of the shackle, but can be moved into a recess of the shackle in the fully or partially opened position of the shackle to release the lock cylinder or the mounting means therefor.

This design means that the first latch member functions as a deadbolt and cannot be opened in the closed position of the lock because its movement is blocked by the shackle.

Since, in a design of this kind, it is possible to prevent movement of the first latch member in the closed position of the shackle, i.e. of the lock, the opening providing access to the first latch member for its release need not be provided in the area of the U-shaped recess but can be provided elsewhere in the lock, for example close to the bottom end of the first latch member. That is to say, access to the first latch member is always possible, but it can only be moved when the lock is fully or partly open.

Although the present invention is preferably used with a padlock of a discus type, it is also of more general application. In this respect, there is provided in accordance with the present invention a lock comprising a housing having a guide channel, a key cylinder, a shackle or bolt member movable in said guide channel between a retracted opened position and an advanced closed position, an abutment member mounted in said housing for moving said shackle or bolt member in response to movement of a key in said key cylinder, means associated with said key cylinder and engageable by a latch member disposed within said lock housing to retain said key cylinder in said lock housing, and means accessible when said shackle or bolt member is in said open, retracted position, permitting access to said latch member to release said key cylinder from said lock housing and permit removal and replacement of said key cylinder.

BRIEF LISTING OF THE FIGURES

The present invention will now be described in further detail by way of example only and with reference to a preferred embodiment as shown in the accompanying drawings, in which are shown:

FIG. 1 is a view of the front side of a padlock in accordance with the present invention, FIG. 2 is a view in the direction of the arrow II in FIG. 1, FIG. 3 a view of two spaced plate members used inside the lock of FIG. 1 as seen from the front in the same direction III of FIG. 2, FIG. 4 is a view in the direction of the arrow IV in FIG. 3, but with certain parts omitted for the sake of clarity, FIG. 5 a view of the lock of FIG. 1 seen in the same direction as the view of FIG. 1, but with the front wall of the lock housing and the front plate removed, with the lock in the closed state, FIG. 6 is a view similar to that of FIG. 5, but with the lock in the open state, FIG. 7 is a view similar to that of FIG. 6, but in which a pin member is used to disengage the first latch member, FIG. 8 is a view on a mounting means for a lock cylinder used in the lock of FIG. 1, with the view of FIG. 8 corresponding to the view in direction II in FIG. 1, but with the mounting means rotated through 180° relative to FIG. 1, FIG. 9 is a view in the direction IX in FIG. 8, FIG. 10 a view in the direction X of FIG. 8, but with the lock cylinder removed, FIGS. 11 and 12 are two drawings closely similar to FIGS. 5 and 7 but showing a slight modification of the lock, and FIG. 13 a perspective view of a modified shackle 14.

DESCRIPTION OF THE PREFERRED EMBODIMENT

Figure 1:
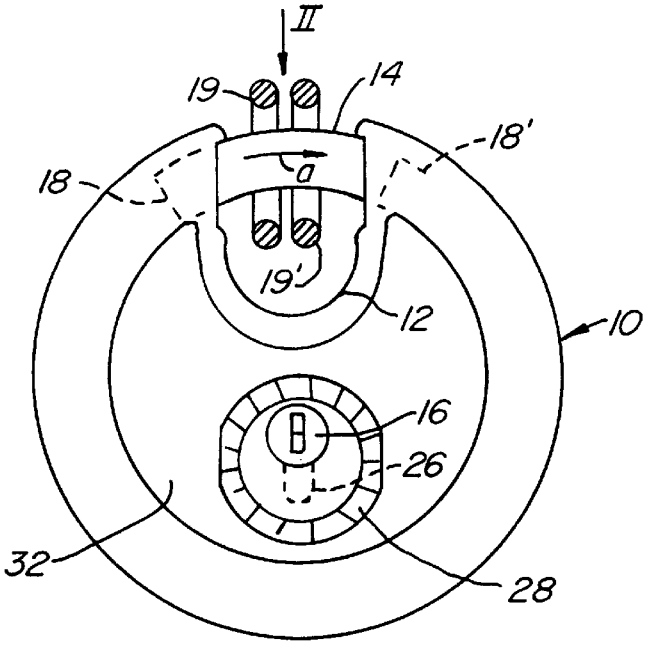

Turning now to FIG. 1, there can be seen a padlock or padlock of the discus type having a lock housing 10 which is circular in side view and which has a generally U-shaped recess 12, which in this drawing is closed at its uppermost side in the drawing of FIG. 1 by a shackle 14. The lock can be opened by moving the shackle 14 by means of a key (not shown) inserted into the lock cylinder 16 by turning the key in the clockwise direction "a" in FIG. 1. This results in a rotation of the shackle 14, which generally has the shape of an open ring, in the same direction "a". This rotation of the shackle 14 takes place from the closed position shown in FIG. 1, in which its end 18 is located within the housing at the left hand side of the U-shaped recess 12, to an open position in which its end has moved to the position 18' at the right-hand side of the U-shaped recess 12 as shown in FIG. 1. In this case the U-shaped recess 12 is open at the top, i.e. at the entry side, so that for example two end links 19, 19' of a chain shown partly sectioned in FIG. 1 can be engaged around the shackle 14 within the U-shaped recess 12. On subsequent closing of the lock by rotation of the key in the anti-clockwise direction, the shackle returns to the position shown in FIG. 1, thus securely retaining the two end links 19, 19' of the chain.

It will be noted from the drawing of FIG. 1 that only the front end of the lock cylinder 16 is visible and that the remainder of the lock cylinder, for example as shown in broken lines at 26, is hidden within a mounting means 28 for the lock cylinder, which will later be described in more detail.

Figure 2:
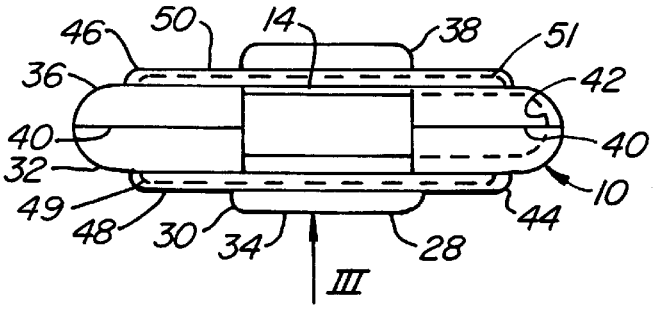

Referring to FIG. 2, it can be seen that the mounting means 28 has a rounded edge 30 at the transition from the front wall 32 of the lock housing to the end face 34 of the mounting means. This makes it very difficult for a person trying to tamper with the lock to get a firm grip on the mounting means 28, such as might be expected in an attempt to break or vandalize a lock.

FIG. 2 also shows that the lock housing has, in addition to the front wall 32, a rear wall 36 of substantially identical shape except that the rear wall has a bulge 38 corresponding generally in shape to the front portion of the mounting means 28 for the lock cylinder 16.

It will also be apparent from the view of FIG. 2, and in particular from the broken lines shown in FIG. 2, that the front and rear walls 32, 36 of the lock housing which meet at the partition line 40 form a generally ring-shaped guide channel 42 which serves to guide the open ring-shaped shackle 14 represented in cross-section by the broken lines in FIG. 2.

It will also be noted that the rounded outside rim portions of each of the front and rear walls 32 and 36 of the housing merge via respective, generally circular, ring steps 44 and 46 into front and rear parallel wall portions 48 and 50. The purpose is to form internal recesses 49, 51 to accommodate first and second plate members 52 and 54, as shown in FIGS. 3 and 4, which accommodate the mechanism of the lock and also serve to join the two halves of the lock housing together.

Figure 3:
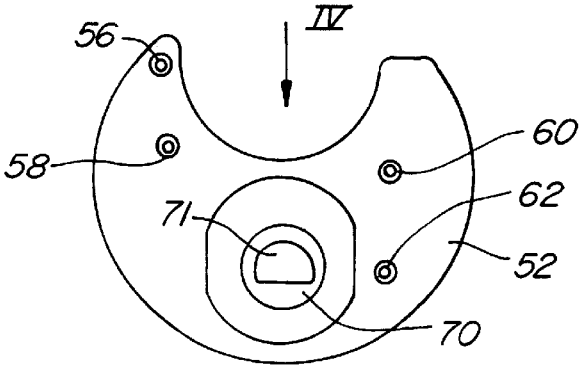
Figure 4:
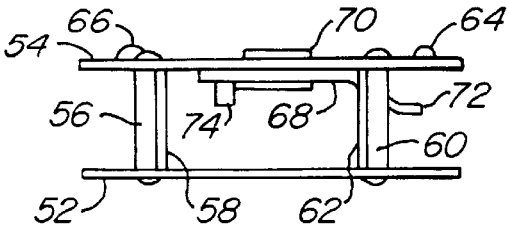

More specifically, it can be Been from FIG. 4 that the front and rear plates 52 and 54 are spaced apart parallel to one another by four spacer members 56, 58, 60, 62 (the ends of which can also be seen in FIG. 3).

The ends of the four spacers 56, 58, 60, 62 are both stepped (as can be seen, for example, from the drawings of FIGS. 5, 6 and 7) and are riveted over at the positions at which they protrude through the front side of the first plate 52 (the lower side in FIG. 4) and the rear side of the second plate 54 (the top side in FIG. 4).

Thus, the spacers 56, 58, 60, 62 and the plates 52, 54 form a rigid assembly. In addition, two hemispherical protrusions 64 and 66 can be seen at the rear side of the plate 54 (in FIG. 4). During assembly of the lock a current is first transmitted through the second plate 54 and through the rear wall 36 of the housing to cause the plate 54 to be welded to the housing at the positions of the protrusions 64, 66. This secures the rigid assembly of the spacers 56, 58, 60, 62 and plates 52, 54 relative to the lock housing 10. During final assembly, after addition of the front plate of the housing, the front and rear walls 32, 36 of the lock housing 10 are welded together along the partition line 40. This welding is effected from about the 1 position to the 11 position in FIG. 1.

In FIG. 4 only part of the lock mechanism is actually shown, namely the cam 68 which is riveted via a tubular rivet 70 to the second plate 54. The riveting is effected in such a way that the cam 68 is rotatable on the tubular rivet 70.

In addition, the view of FIG. 4 allows a protruding abutment member 72 on the cam 68 to be seen, which—as will later be explained—engages into a recess in the ring-shaped shackle. Furthermore, the view of FIG. 4 permits a lug 74 to be seen which limits the rotation of the cam relative to the lock cylinder (by abutment against part 26, FIGS. 1 and 9).

Figure 5:
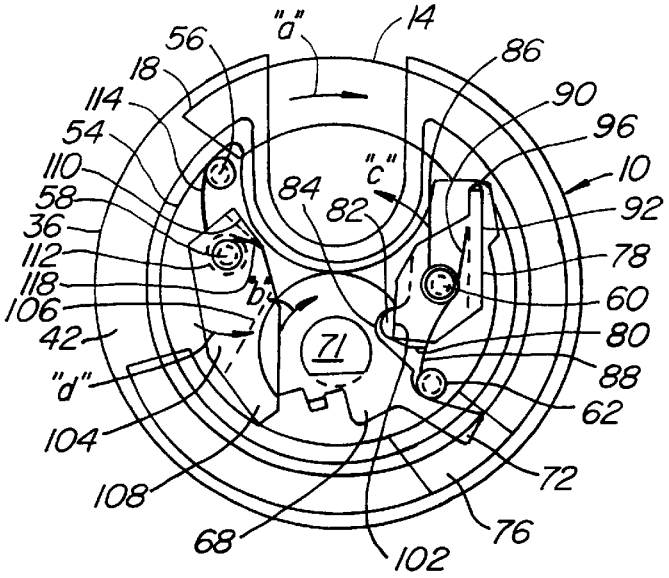

Turning now to FIG. 5, the lock is shown with the front wall 32 of the lock housing 10 and the first front plate 52 of the lock mechanism removed.

In the view of FIG. 5 it is first possible to see the recess 76 in the open or C-shaped shackle 14. It is also possible to see the abutment 72 engaged in the recess 76 of the shackle. Moreover, it will be noted that the abutment member 72 is in contact with the spacer member 62 limiting rotation of the shackle 14 in the closing direction.

The drawing of FIG. 5 also shows in side view a catch member 78 which is pivotally journalled on the spacer 60 between the first and second plates 52, 54. The catch member 78 is of U-shape and has a rear limb 80 which is represented in part by the broken line in FIG. 5. The rear limb 80 has a rounded nose 82 which engages with a cut-out 84 in the cam 68. The reference numeral 86 indicates a spring which has coils around the spacer member 60, a first limb 88 which abuts against the spacer 62, and a second limb 90 which abuts against the web portion 92 of the catch member 78 and biases the catch member 78 in the clockwise direction "a" as seen in FIG. 5. That is to say, the spring 86 serves to keep the nose 82 engaged in the recess 84 of the cam and also serves to keep the web 92 of the catch member engaged in a recess 96 in the shackle 14, which prevents rotation of the shackle 14 in the opening direction shown by the arrow "a".

It will be noted that the second limb 102 of the catch member 78 extends parallel to the first limb 80 and terminates in a straight edge portion, to which the lead line for the reference numeral 102 extends, the purpose of which will be explained later.

A latch member 104 can be seen to the left of the cam 68 in FIG. 5, which is again of generally U-shape, having a first limb 106 represented by the broken line, a second limb 108 overlapping the front of the cam 68 in FIG. 5 and a web member 110 which joins the front and rear limbs 106, 108 of the latch member 104. The latch member 104 is pivotally mounted about the spacer 58 and is biased by a second spring 112 resembling the spring 86 for the catch member 78. The second spring 112 has a first limb 114 contacting the spacer member 56, coils around the spacer member 58 and a second limb 118 engaged with the web 110 of the latch member 104. The spring 112 serves to bias the latch member 104 in the anti-clockwise direction into the position shown in FIG. 5.

Figure 6:
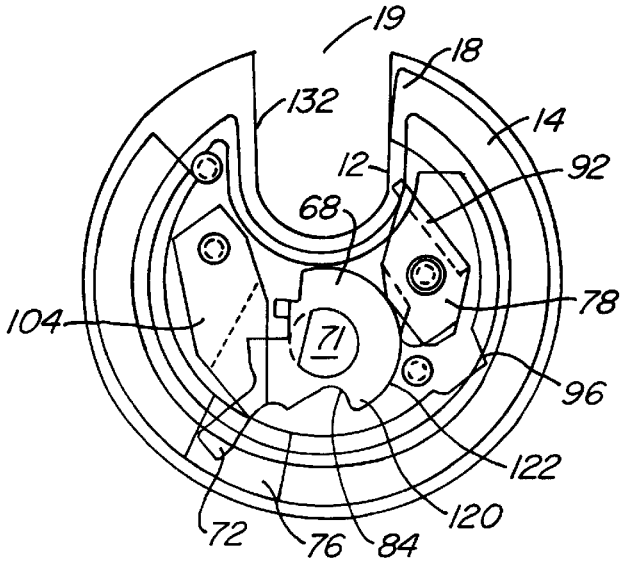

FIG. 6 shows the same situation as in FIG. 5, but with the shackle 14 in the open position after the cam 68 has been rotated by the key and the lock cylinder through about 120° in the clockwise direction.

First of all it will be noted that the abutment member 72 is now engaged with the opposite side of the recess 76 and has rotated the shackle 14 in the direction of the arrow "a" of FIG. 5 into the open position in which the entry 19 to the U-shaped recess 12 is free (enabling the chains to be removed or inserted into the lock, as the case may be). At the start of this rotation, the cam nose 120 adjacent the cam recess 84 first rotates the catch member 78 in the anti-clockwise direction so that the web 92 disengages from the recess 96 in the open ring-shaped shackle 14. After this initial opening movement of the catch member 78, the nose 82 thereof slides on the circular surface 122 of the cam 68, so that no further rotational movement takes place.

During this opening movement the latch member 104 remains in the position shown in FIG. 5.

Figure 7:
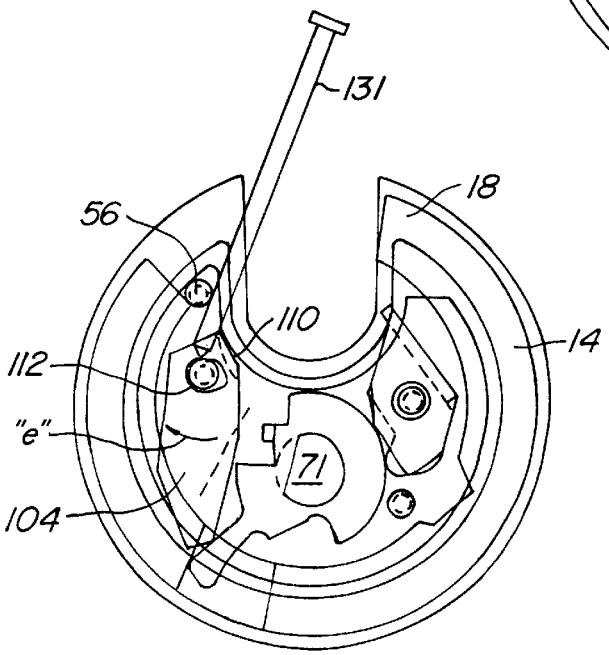

It will also be noted from the drawings of FIGS. 5, 6 and 7 that the tubular rivet 70 actually has a D-shaped aperture 71, and this serves to accommodate a corresponding dog 98 of D-shaped section of the lock cylinder (shown in FIGS. 8 and 9,) so that torque can be transmitted from the lock cylinder to the cam 68 in both directions of rotation of the key in the lock cylinder.

The drawing of FIG. 7 shows basically the same situation ms in FIG. 6 but indicates that a pin 113 can be inserted between the spacer 58 and the web 110 of the latch member 104, and indeed through an opening 132, into which the end 18 of the shackle 14 engages in the closed position of the lock. By pushing the tapered end of the pin 113 through the space between the spacer 56 and the web 110, optionally with a small turning movement in the anti-clockwise direction, the latch member 104 can be pivoted against the force of the spring 112 in the position shown into FIG. 7.

Figure 10:
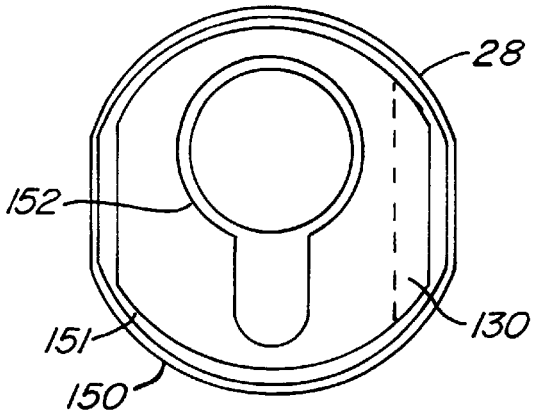
Figure 8:
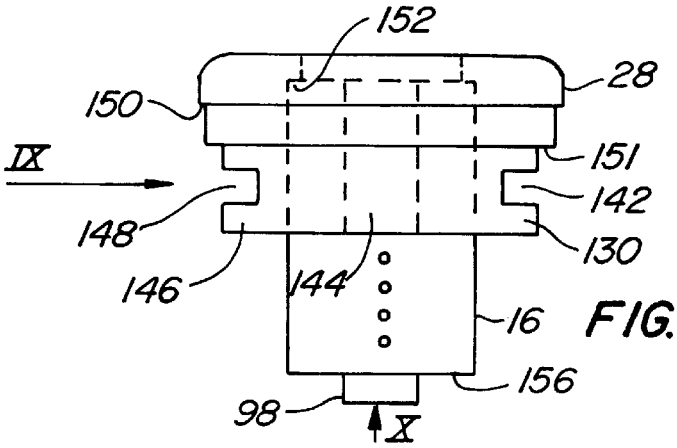

That is to say, the latch member 104, more specifically the limb 108 of the latch member 104, is now also disengaged from the shoulder 130 of the mounting means 28 for the lock cylinder 16, as shown in FIGS. 8 and 10.

FIG. 8 shows that the shoulder 130 is defined by a groove 142 milled into one side of a spigot 144 of the mounting means 28. In addition, FIG. 8 also shows the second shoulder 146, again formed by a groove 148 milled into the mounting means 28, with the groove 148 accommodating the second latch member formed by the limb 102 of the catch member 78, when the latter is in the position shown in FIG. 5, i.e. when the lock is closed.

Figure 9:
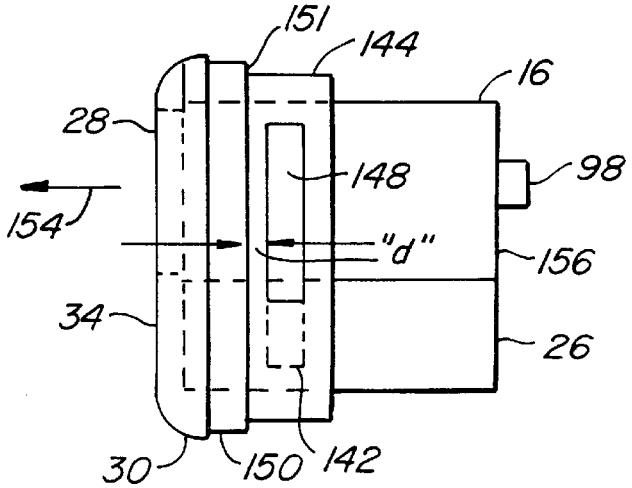

The groove 148 can be seen in side view in FIG. 9. The same side view indicates that the groove 142 for the latch member 104 is extended downwardly further than the groove 148.

In addition, FIGS. 8, 9 and 10 show the step 150 formed between the spigot portion 144 of the mounting means 28 and the portion 30 of greater diameter, which protrudes from the front face of the lock in FIG. 1. In this design a second step 151 contacts the front face of the plate 52, i.e. the lower plate in FIG. 4. The distance "d" between the step 151 and the edges of the grooves 142, 148 close to it corresponds to the thickness of the first plate 52. This means that the mounting means 28 is securely trapped in the first plate 52 between the shoulder 150, on the one side, and between the first and second latch members on the other side.

In addition, FIGS. 8 and 10 show a shoulder 152 within the mounting means 28, which prevents the lock cylinder 16 from moving out of the mounting means 28 in the direction of the arrow 154 in FIG. 9. The other end face 156 of the lock cylinder confronts directly the front face of the tubular rivet 70 securing the cam 68 (apart from the driving dog which projects beyond it) and this prevents the movement or the lock cylinder 16 away from the shoulder 152.

Thus, the operation of the lock as described above will be understood to be as follows:

In FIG. 5 the padlock is shown in its closed position within the circular casing 10 having the U-shaped recess 12. The open, ring-shaped shackle 14 is located within the casing 10 and is slidable between the locked position of FIG. 5 and the open position of FIG. 6 by movement in the direction indicated by the arrow a.

The sliding of the shackle 14 is initiated by turning a key (not shown) in the lock cylinder (also not shown in FIG. 5), thereby turning the control cam 68, which is connected to the lock cylinder. The control cam 68 is provided with the projection 72 which engages into the recess 76 in the shackle 14.

In order to open the lock, the control cam 68 is rotated in direction b via the lock cylinder 16 and in this way the shackle 14 is moved to the position shown in FIG. 6.

In the closed position (FIG. 5) the shackle 14 is locked by the catch 78, which engages the locking edge 96 of the shackle 14. In order to move the shackle 14 into the open position (FIG. 6), the control cam 68 rotates catch 78 in direction c so that catch 78 no longer blocks shackle 14 via engagement of the web 92 with the side 96 of the locking recess.

It is an important feature of the lock that it is rekeyable, which means that the lock cylinder can be exchanged.

To achieve the possibility of exchanging the lock cylinder 16, catch 78 has a double function in the present lock. On the one hand, catch 78 serves to block the shackle 14 in the closed position. On the other hand, the portion 102 of catch 78 engages into the groove 148 (FIG. 8) of the cylinder housing or mounting means 28 in front of the shoulder 146 in order to fix the cylinder housing 28 in the lock. By turning the catch 78 in direction c, portion 102, the second latch member, is moved away from the groove recess 148, so that the cylinder housing 28 is no longer fixed in the lock by catch 78. The corresponding position of catch 78 is shown in FIG. 6.

To prevent the cylinder housing 28 from being removed from the lock in the open position (FIG. 6), the first latch member 104 is provided, which is biased in direction "d" (FIG. 5). Latch 104 engages the second groove or recess 142 (FIG. 8) of the cylinder housing 28 in front of the shoulder 130 and therefore secures the cylinder housing 28 in the lock when the lock is open.

In order to remove the cylinder housing 28 (with the lock cylinder 16) from the lock, an instrument, for example the nail 131, can be inserted in the lock via the opening 132 (see FIG. 7). The latch 104 can be turned by the nail 131 against its biasing force in direction e so that the latch 104 no longer engages with the groove 142 of the cylinder housing 28. In this position, which is shown in FIG. 9, the cylinder housing 28 can be removed from the lock. Thereafter, the latch cylinder (if separate from the cylinder housing 28) can be simply withdrawn axially from the cylinder housing and replaced by a new lock cylinder operable with a new key. The process of inserting the rekeyed lock cylinder into the lock takes place in reverse sequence to its removal, as described above.

It will be noted that the lock as described above can also be realized in a special way, making it even more secure and also permitting access to the first latch member in an alternative and possibly more convenient manner.

Figure 11:
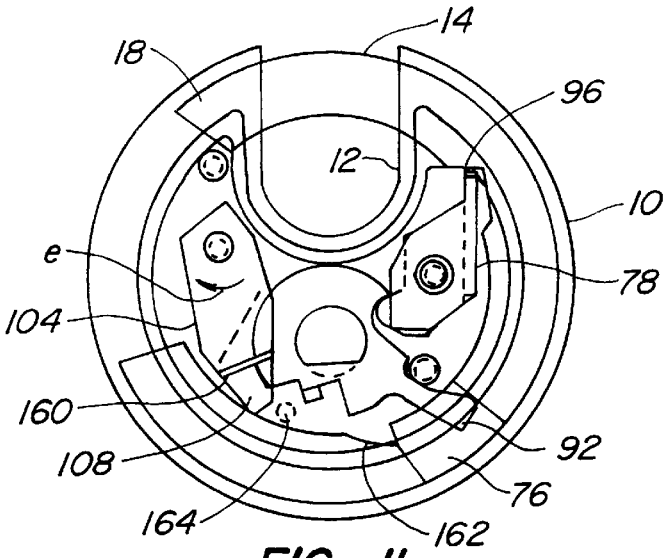
Figure 12:
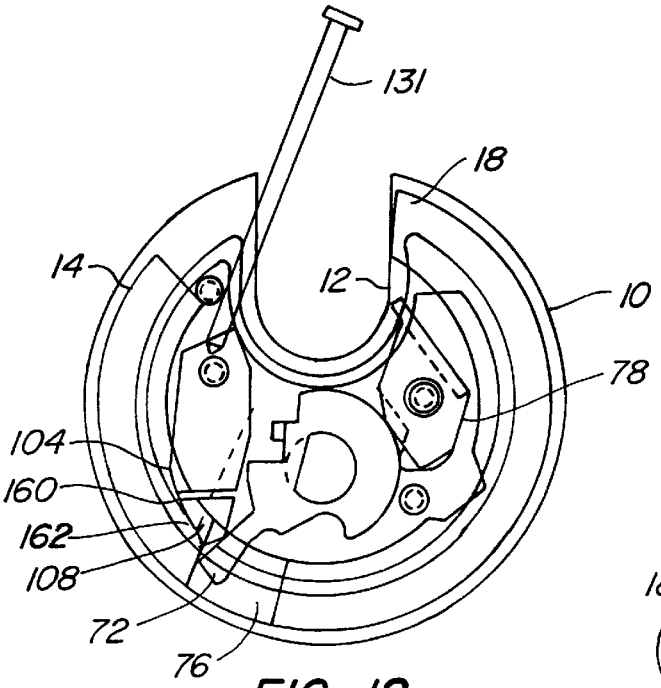
Figure 13:
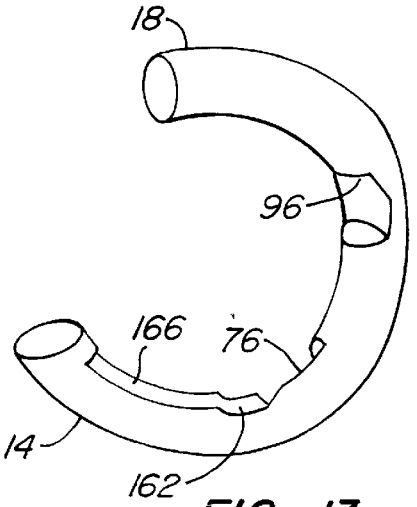

This modification is shown in FIGS. 11, 12 and 13, which are very similar to FIGS. 5 and 7.

It will be noted that in FIG. 11 the bottom end of the first latch member 104 has been deflected at a bend or jog 160 towards the central plane of the lock, i.e. the plane containing the partition line 40, so that it now contacts or nearly contacts the surface of the C-shaped shackle 14 in the closed position of the lock. This is not the case in FIG. 5 (although it may appear so in the drawing) because the relevant limb of the latch member is laterally displaced from the central plane of the lock, where the shackle 14 has the smallest internal diameter. Thus, in the modification of FIGS. 11 and 12 the first latch member acts as a deadbolt and cannot be released when the shackle is in the closed position.

However, the shackle is provided with a cut-out 162 adjacent the recess 76 which provides sufficient clearance for the first latch member 104 to be moved in the direction of the arrow "e" when the shackle 14 is open. Clearly the cut-out 162 could also be positioned such that movement of the first latch member 104 to release the lock cylinder is also possible in an intermediate position of the shackle 14.

Since the first latch member 104 cannot be opened when the shackle 14 is closed, i.e. the lock is closed, it is possible to provide the access opening for the latch member outside of the unshaped recess 12, for example as indicated by the opening 164 in FIG. 11.

Finally, FIG. 13 shows the shackle on its own and indeed in this case in a modified version with a flattened portion 166 adjacent the bottom end of the latch member on which the bottom end of the latch member 104 rests in the closed position of the shackle. This makes the positioning of the bottom end of the latch member less critical and can obviate the need for the bend 160 in the first latch member.

We claim:

1. Padlock comprising a lock housing; a generally U-shaped recess formed in said lock housing and having an entry side; a guide channel defined within said housing; a shackle movable within said channel between an open position in which said shackle is retracted into said housing and frees said entry side of said recess, and a closed position in which said shackle is partly located outside of said housing and closes off said entry side; a lock cylinder; means removably mounting said lock cylinder in said lock housing; a cam movable by said lock cylinder and having an abutment member engageable with said shackle to move said shackle from said open position to said closed position and from said closed position to said open position; a latch member biased into position in front of a shoulder of said mounting means prohibiting withdrawal of said lock cylinders; and means accessible through said recess when said shackle is in said open position, but not when said shackle is in said closed position, for releasing said latch member from said shoulder to permit withdrawal of said mounting means and said lock cylinder from said lock housing and replacement of said lock cylinder by a substitute lock cylinder.

2. Padlock in accordance with claim 1, wherein a catch member is provided which is biased in said closed position of said shackle against an abutment provided there on to prevent opening movement of said shackle, wherein said mounting means has a second shoulder at a side opposite from the first said shoulder, wherein said cam is adapted to move said catch member out of engagement with said abutment to release said shackle, and wherein said catch member carries a second latch member engageable in front of said second shoulder in said closed position of said shackle.

3. Padlock in accordance with claim 1, wherein said lock cylinder is integral with said mounting means.

4. Padlock in accordance with claim 3, wherein said lock cylinder is separate from said mounting means.

5. Padlock in accordance with claim 4, wherein said lock cylinder has first and second ends with a key insertion opening at said first end and a driving dog at said second end, wherein said mounting means has a recess complementary to an outer profile of said lock cylinder for receiving a portion of said lock cylinder and an abutment engageable with said first end of said lock cylinder to prevent movement of said lock cylinder through said mounting means, and wherein said driving dog is engageable within a recess or aperture of complementary shape in said cam for transmitting torque to said cam on rotation of said key with said cam member or means associated therewith preventing movement of said lock cylinder away from said mounting means.

6. Padlock in accordance with claim 2, wherein said cam, said latch member and said catch member are disposed between first and second internal plates of said housing, there being spacer means provided between said first and second plates maintaining said first and second plates at a predetermined spacing from one another, wherein said mounting means has a spigot member of non-circular cross-section and a step forming a transition into a portion of greater diameter, wherein said non-circular spigot portion engages into a complementary aperture in at least one of said first plate and a front wall of said lock housing and prevents rotation of said mounting means relative to said plate and to said lock housing, and wherein the first said shoulder is defined on the opposite side of said first plate from said step, and said latch member engages between said shoulder and said first plate.

7. Padlock in accordance with claim 6, wherein said portion of said mounting means of greater diameter has a round cross-section and is insertable into said lock housing through an aperture of complementary shape provided in said lock housing.

8. Padlock in accordance with claim 6, wherein said portion of said mounting means of greater diameter has an end face, projects at least partly outside of said lock housing and has a rounded surface extending from a wall of said lock housing to said end face.

9. Padlock in accordance with claim 6, wherein said cam member is rotatably connected to said second plate member opposite to said first plate member by a hollow rivet, said hollow rivet having an internal passage complementary in shape to said driving dog.

10. Padlock in accordance with claim 6, wherein said latch member is pivotally supported on a pin extending between said first and second plates.

11. Padlock in accordance with claim 10, wherein a spring member surrounds said pin and biases said latch member into position in front of said shoulder.

12. Padlock in accordance with claim 10, wherein said latch member is generally of a U-shape having first and second limbs, one of which engages in front of the first said shoulder.

13. Padlock in accordance with claim 6, wherein said catch member is pivotally supported on a pin extending between said first and second plates.

14. Padlock in accordance with claim 13, wherein a spring member surrounds said pin and biases said catch member towards a position in front of said second shoulder.

15. Padlock in accordance with claim 10, wherein said catch member is generally of a U-shape having first and second limbs, one of which engages in front of the first said shoulder, and wherein the other said limb of said catch member cooperate s with said cam.

16. Padlock in accordance with claim 2, wherein said cam has a recess accommodating a projection of said catch member when said shackle is in said closed position, thereby permitting said catch member to contact said abutment.

17. Padlock in accordance with claim 1, wherein said latch member is accessible through an opening provided in said housing for receiving an end portion of said shackle when said shackle is in said closed position.

18. Padlock in accordance with claim 6, wherein said latch member is accessible through an opening provided in said housing for receiving an end portion of said shackle when said shackle is in said closed position, and wherein a release member is provided on one or both of said first and second plates adjacent to said opening and adjacent to a portion of said latch member such that a tool can be inserted between said release member and said portion to release said latch member from the first said shoulder.

19. Padlock in accordance with claim 1, wherein said lock housing comprises first and second, generally disc-like housing members, each having a respective Un-shaped recess, and a rounded rim portion, said rounded rim portions confronting one another when said housing parts are assembled to form a ring channel for receiving a shackle member in the shape of a C-shaped ring.

20. Padlock in accordance with claim 6, wherein said lock housing comprises first and second, generally disc-like housing members, each having a respective U-shaped recess, and a rounded rim portion, said rounded rim portions confronting one another when said housing parts are assembled to form a ring channel for receiving a shackle member in the shape of a C-shaped ring, and wherein means is provided for connecting each of said first and second plates to a respective one of said disc-like housing members.

21. Padlock in accordance with claim 1, wherein said mounting means has a spigot member of non-circular cross-section and a step forming a transition into a portion of greater diameter, wherein said non-circular spigot portion engages into a complementary aperture in a front wall of said lock housing and prevents rotation of said mounting means relative to said lock housing and wherein the first said shoulder is defined on the opposite side of said front wall from said step and said latch member engages between said shoulder and said front wall of said housing.

22. Lock comprising a lock housing; a generally U-shaped recess formed in said lock housing and having an entry side; a guide channel defined within said housing; a shackle movable within said channel between an open position in which said shackle is retracted into said housing and frees said entry side of said recess, and a closed position in which said shackle is partly located outside of said housing and closes off said entry side; a lock cylinder; means removably mounting said lock cylinder in said lock housing; a cam movable by said lock cylinder and having an abutment member engageable with said shackle to move said shackle from said open position to said closed position and from said closed position to said open position; a latch member biased into position in front of a shoulder of said mounting means prohibiting withdrawal of said lock cylinder; and means accessible when said shackle is in said open position, for releasing said latch member from said shoulder to permit withdrawal of said mounting means and said lock cylinder from said lock housing and replacement of said lock cylinder by a substitute lock cylinder.

23. Lock in accordance with claim 22, wherein in said closed position of the latch member said shackle is positioned sufficiently close to said latch member to prevent said latch member from being released from said mounting means and wherein said shackle has a cut-out permitting release of said latch member from said mounting means when said shackle is in one of a fully open position and a partly open position.

24. Lock in accordance with claim 23, wherein an opening providing access to said first latch member is provided outside of said U-shaped recess.

25. Lock comprising a housing having a guide channel, a key cylinder, a shackle or bolt member movable in said guide channel between a retracted opened position and an advanced closed position, an abutment member mounted in said housing for moving said shackle or bolt member in response to movement of a key in said key cylinder, means associated with said key cylinder and engageable by a latch member disposed within said lock housing to retain said key cylinder in said lock housing, and means accessible when said shackle or bolt member is in said opened retracted position, permitting access to said latch member to release said key cylinder from said lock housing and permit removal and replacement of said key cylinder.

* * * * *